US005333358A

United States Patent [19]

Leifeld

[11] Patent Number: 5,333,358

[45] Date of Patent: Aug. 2, 1994

[54] FEEDING DEVICE FOR A FIBER TUFT CLEANING AND OPENING APPARATUS

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 854,064

[22] Filed: Mar. 19, 1992

[30] Foreign Application Priority Data

Mar. 19, 1991 [DE] Fed. Rep. of Germany ..... 4108920
Jan. 10, 1992 [DE] Fed. Rep. of Germany ..... 4200394

[51] Int. Cl.[5] ..... D01G 15/40
[52] U.S. Cl. ..... 19/105; 19/204
[58] Field of Search ..... 19/150, 204, 205, 200, 19/202, 105, 96, 97.5, 96, 645

[56] References Cited

U.S. PATENT DOCUMENTS

| | | | |
|---|---|---|---|
| 4,035,871 | 7/1977 | Stahlecker | 19/96 |
| 4,222,154 | 9/1980 | Stäheli et al. | 19/105 |
| 4,346,500 | 8/1982 | Demuth | 19/105 |
| 4,509,730 | 4/1985 | Shtarkman | 267/35 |
| 4,742,675 | 5/1988 | Leifeld . | |
| 4,817,247 | 4/1989 | Leifeld et al. | 19/105 |
| 4,860,406 | 8/1989 | Stäheli et al. | 19/105 |
| 5,038,439 | 8/1991 | Verzilli | 19/105 |

FOREIGN PATENT DOCUMENTS

| | | |
|---|---|---|
| 1797108 | 10/1959 | Fed. Rep. of Germany . |
| 1172166 | 6/1964 | Fed. Rep. of Germany . |
| 2826101 | 4/1987 | Fed. Rep. of Germany . |
| 2826102 | 4/1987 | Fed. Rep. of Germany . |
| 3711640 | 10/1988 | Fed. Rep. of Germany . |
| 4038838 | 7/1991 | Fed. Rep. of Germany . |
| 480625 | 2/1938 | United Kingdom . |
| 1375552 | 11/1974 | United Kingdom . |
| 2001366 | 1/1979 | United Kingdom . |
| 2189519 | 10/1987 | United Kingdom . |
| 2198461 | 6/1988 | United Kingdom . |
| 2210644 | 6/1989 | United Kingdom . |
| 2240996 | 8/1991 | United Kingdom . |

*Primary Examiner*—Clifford D. Crowder
*Assistant Examiner*—Larry D. Worrell, Jr.
*Attorney, Agent, or Firm*—Spencer, Frank & Schneider

[57] ABSTRACT

A feeding device for advancing a fiber lap to a fiber processing machine includes a driven a feed roll and a feed tray cooperating with the feed roll and defining a nip therewith for advancing the fiber lap in a feed direction by a clamping effect exerted to the fiber lap in the nip by the feed roll and the feed tray. The feed tray has a working face oriented towards the feed roll and an outer face being opposite the working face. There is further provided a support arrangement for supporting the feed tray for displacements towards and away from the feed roll and a force-exerting member connected to the feed tray for urging the working face of the feed tray towards the feed roll.

21 Claims, 4 Drawing Sheets

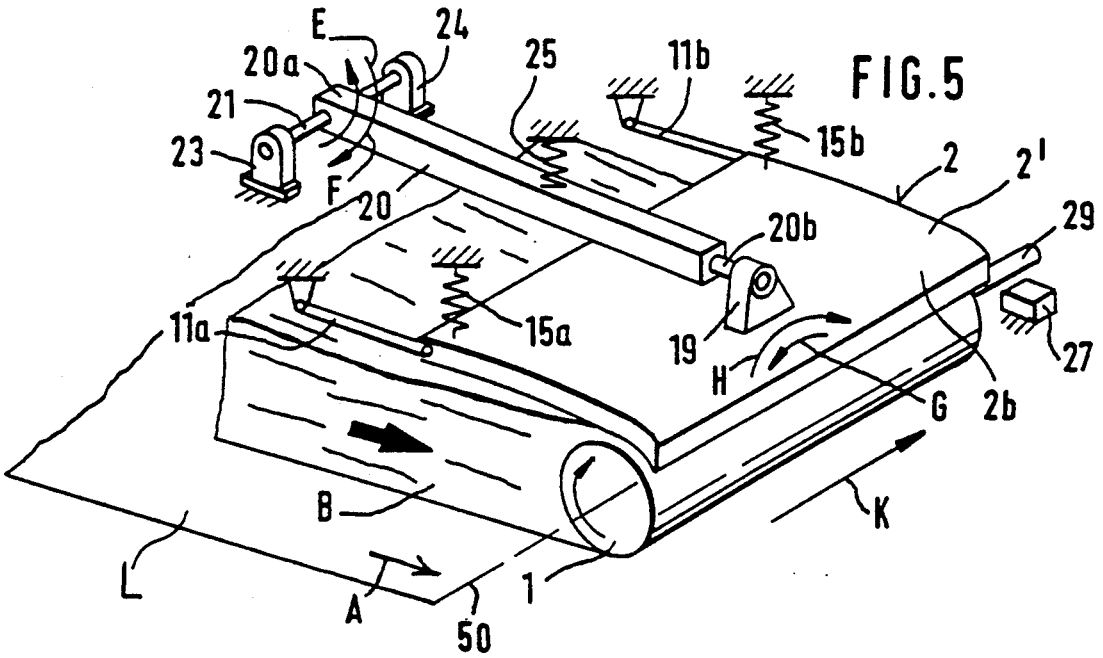
FIG.5
FIG.6
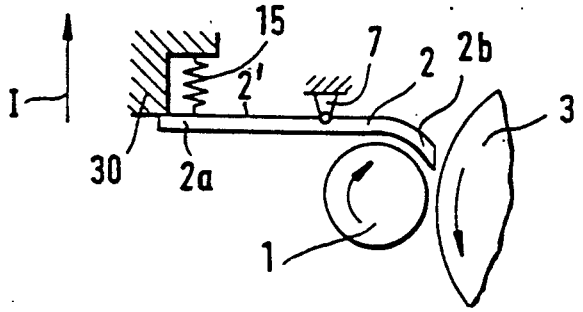
FIG.7
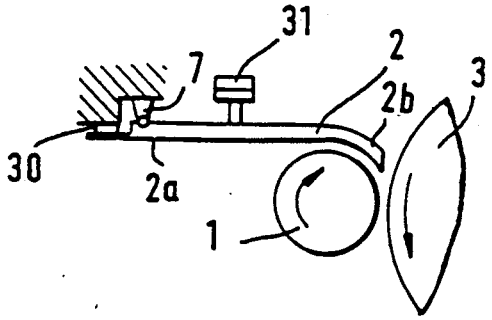

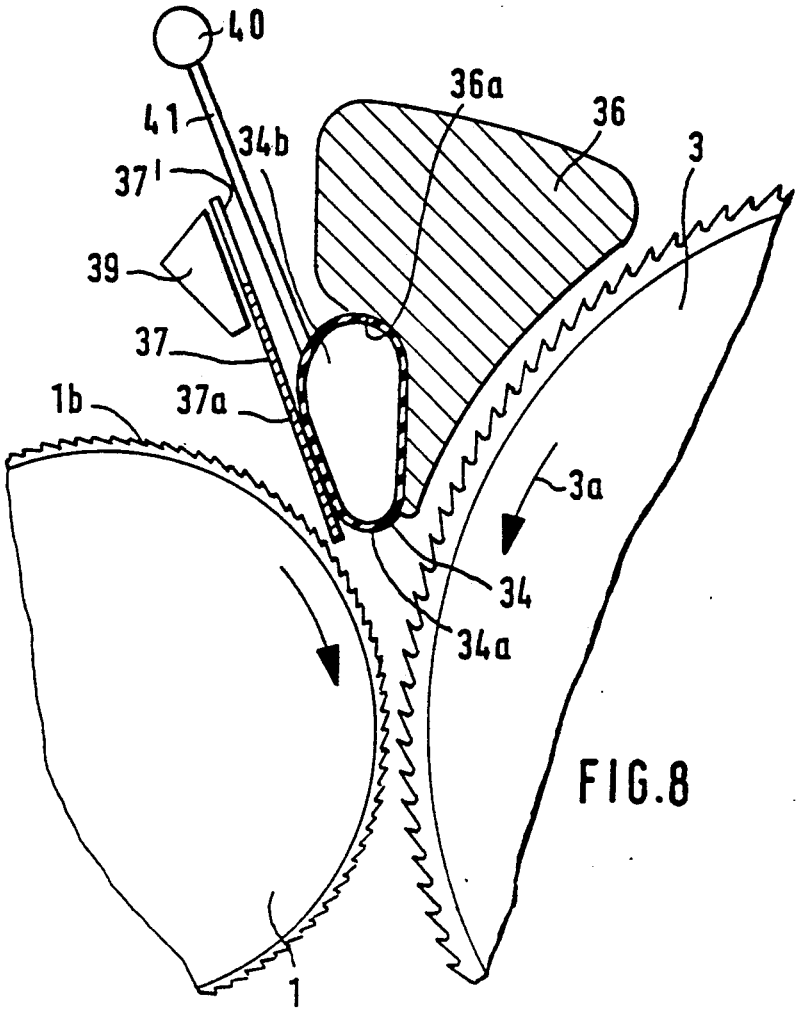
FIG.8
FIG.9
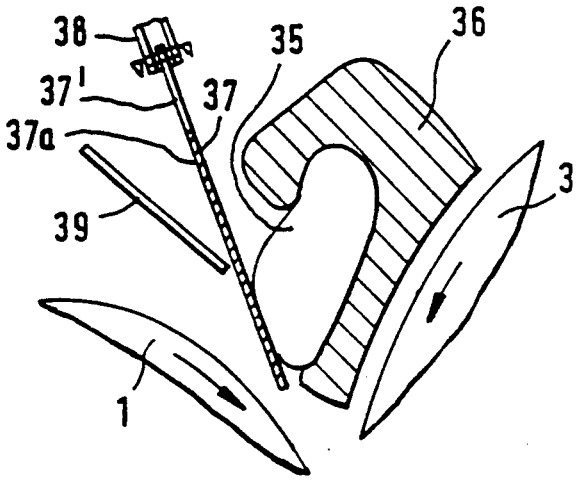
FIG.10
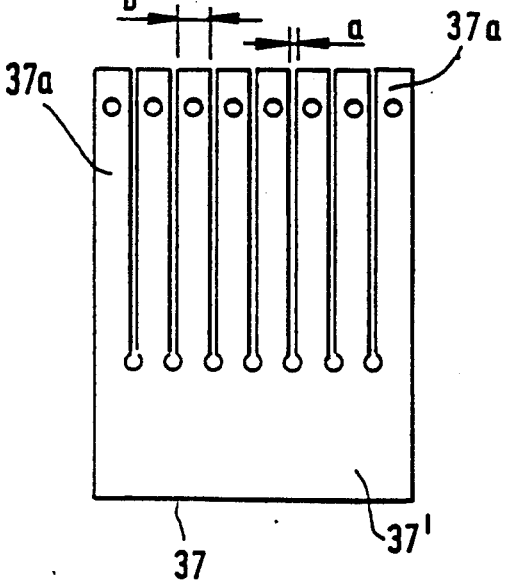

FEEDING DEVICE FOR A FIBER TUFT CLEANING AND OPENING APPARATUS

CROSS REFERENCE TO RELATED APPLICATION

This application claims the priority of German Application Nos. P 41 08 920.0 filed Mar. 19, 1991 and P 42 00 394.6 filed Jan. 10, 1992, which are incorporated herein by reference.

BACKGROUND OF THE INVENTION

This invention relates to an apparatus for cleaning and opening fiber material such as cotton, synthetic fiber or the like in fiber tuft form. The fiber tuft mass passes through a feeding device, for example, a feed roll cooperating with a feed tray and at least an opening device such as an opening roll with a cleaning arrangement. Thereafter, the cleaned and opened fiber material is advanced to a further fiber processing machine.

Conventionally, the feeding device comprises a shiftable feed roll which cooperates with a sheet-metal feed tray. The latter is mounted on a transverse beam and is adjustable during operation to effect a clamping of the fiber against the feed roll. The feed roll and the opening roll rotate in the same direction. It is a disadvantage of such a prior art arrangement that only small flow rates are feasible. It has been found that at higher flow rates problems are encountered which have not yet been resolved. Thus, the feed tray has caused jamming upon the introduction of the fiber material when the flow rate has exceeded a predetermined level, resulting in damages to the fiber or in an unsatisfactory clamping throughout the width of the fiber mass.

SUMMARY OF THE INVENTION

It is an object of the invention to provide an improved feeding device of the above-outlined type from which the discussed disadvantages are eliminated and with which, in particular, a high flow rate may be achieved without operational disturbances, such as clogging or fiber damage.

This object and others to become apparent as the specification progresses, are accomplished by the invention, according to which, briefly stated, the feed tray of the feeding device is displaceably mounted and is biased towards the feed roll by a force-exerting element.

By virtue of the fact that according to the invention the feed tray is movably supported so that during operation it may undergo excursions and is biased by a force-exerting element, the feed tray yields even at high flow rates. With the movable, biased support of the feed tray a highly satisfactory clamping in cooperation with the feed roll may be achieved. The feed tray and the feed roll which has a rotary cylindrical surface, form mutual counterelements. The fibers slide on the tray surface whereby a relative motion between fiber material and feed tray surface occurs. The slowly rotating feed roll pulls the fibers across the feed tray surface which, as a non-rotary face, may yield even at high flow rates in response to varying thicknesses of the fiber lap. In this manner, a high flow rate and good clamping effect are coupled with an operationally safe functioning of the opening and cleaning apparatus.

BRIEF DESCRIPTION OF THE DRAWING

FIGS. 2–5 are schematic perspective views of four further preferred embodiments of the invention.

FIGS. 6–9 are schematic side elevational views of four additional preferred embodiments of the invention.

FIG. 10 is a plan view of an element forming part of the embodiment shown in FIG. 9.

DESCRIPTION OF THE PREFERRED EMBODIMENTS

Figure 1:
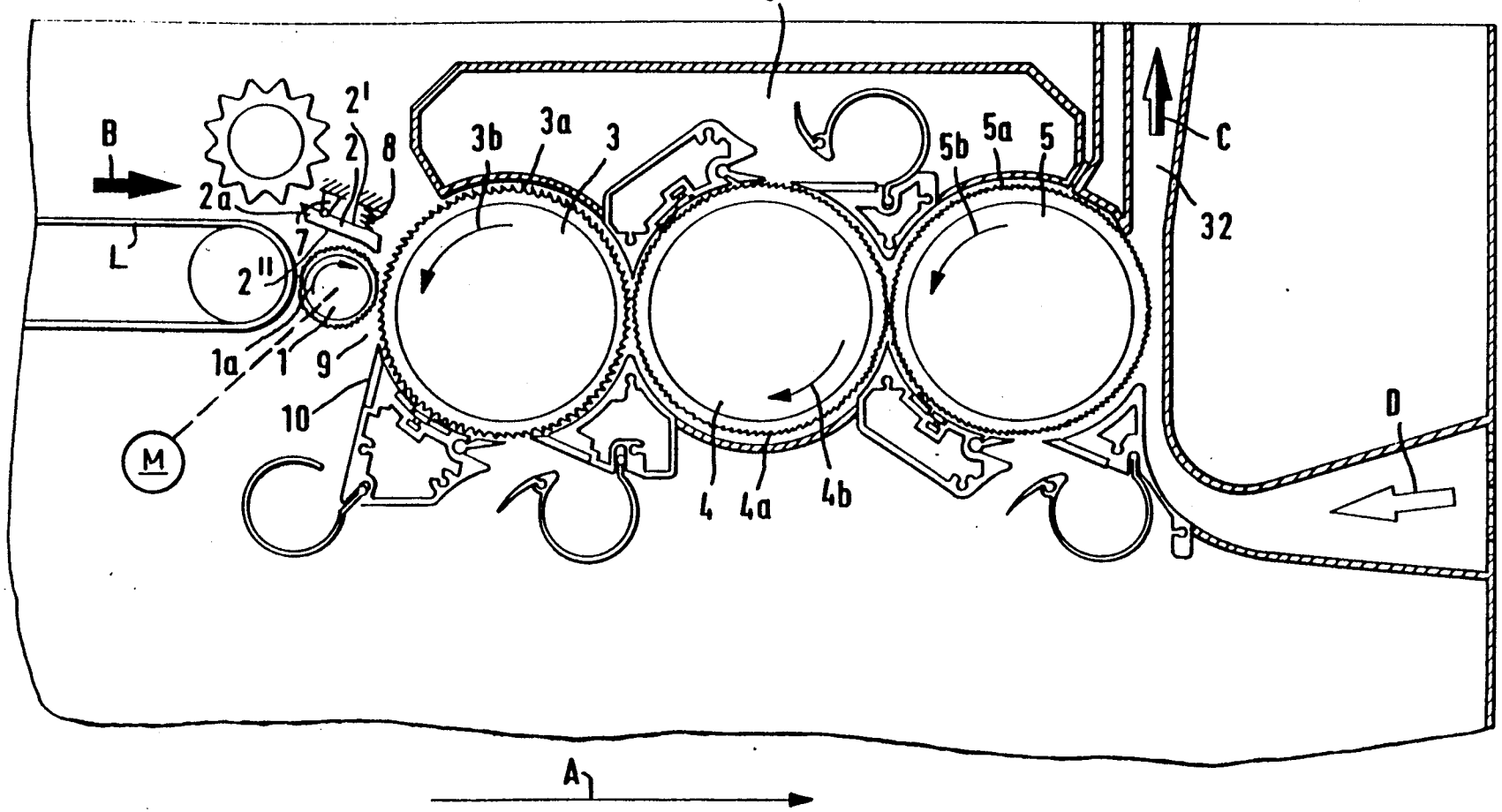
FIG. 1 is a schematic side elevational view of a preferred embodiment of the invention.

Turning to FIG. 1, fiber material B, such as cotton, to be opened and cleaned is introduced into a cleaning and opening apparatus as a mass of fiber tufts advanced on a feed conveyor L. The fiber mass (fiber lap) is clamped in the nip between a feed roll 1 rotating in the direction of arrow 1*a* and a feed tray 2 which is situated above the feed roll 1. The feed roll 1 which is driven by a motor M and the feed tray 2 form a feeding device to be described in greater detail later.

The feeding device 1, 2 advances the fiber material to a pinned roll 3 which may have a diameter of between 150 and 300 mm, for example, 250 mm. The roll 3 rotates counterclockwise as indicated by the arrow 3*b* at a circumferential speed of approximately 10–21 m/sec, for example, 15 m/sec. The roll 3 is followed by a sawtooth roll 4 which has a diameter of, for example, 250 mm and a circumferential speed of approximately 15–25 m/sec, for example, 20 m/sec. The roll 4, in turn, is followed by a clothed roll 5, whose circumferential speed is greater than that of the roll 4; the diameter of the roll 5 is, for example, 250 mm.

The pinned roll 3 is surrounded by a housing 6 and is associated with a waste discharge opening 9 for the passage of fiber impurities. The size of the waste discharge opening 9 which is bounded by a mote knife 10 is adaptable to the grade of impurity of the fiber material.

The feed tray 2 of the feeding device is, at its end 2*a*, supported in a rotary bearing 7. The outer upper face 2' of the feed tray 2 is engaged by a compression spring 8 which resiliently biases the feed tray 2 towards the rotary feed roll 1 which is stationarily supported. The distance between the lower face 2'' of the feed tray 2 and the feed roll 1 decreases in the feed direction of the fiber lap to a minimum in the clamping plane of the nip. The lower face 2'' is a working face of the tray 2, that is, a tray face which directly engages the fiber lap during operation.

The above-described apparatus operates as follows:

The fiber tufts, forming the fiber lap B are, under the clamping effect of the cooperating feed roll 1 and feed tray 2 advanced to the pinned roll 3 which combs the fiber lap B and entrains fiber bundles on its pins. As the pins of the roll 3 pass by the waste discharge opening 9 and the mote knife 10, short fibers and coarse impurities are thrown from the fiber material by centrifugal forces, dependent upon the circumferential speed and the curvature of the roll 3 as well as the adjusted size of the waste discharge opening 9 adapted to the first separating stage. The fiber material pre-cleaned in this manner is doffed by the clothing points 4*a* of the clothed roll 4, whereby further opening of the fiber material takes place. Thereafter, the fiber material is taken over by the clothing points 5*a* of the roll 5 which is situated downstream of the roll 4 as viewed in the working direction A. The roll 5 opens the fiber material still further and the latter is removed from the roll 5 by a pneumatic suction device 32 and advanced to a further fiber processing machine.

Figure 2:
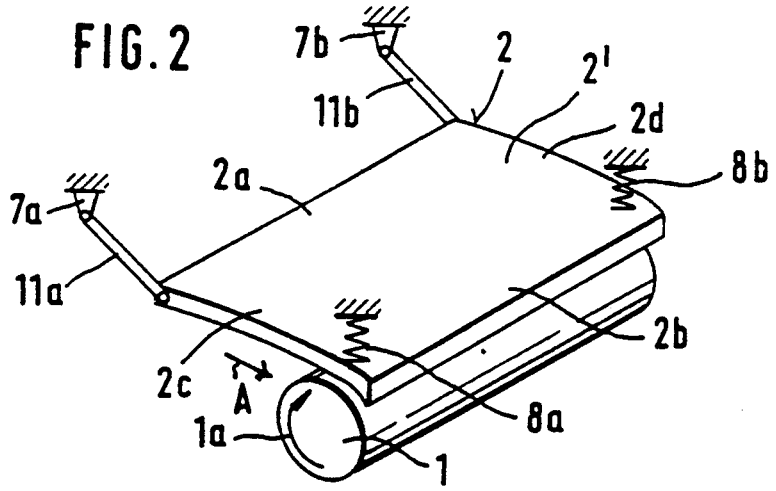

Turning now to FIG. 2, at the upstream end (as viewed in the direction of fiber feed) 2*a* of the feed tray 2 there are provided linkages 11*a* and 11*b* which, at one end, are articulated to opposite sides 2*c* and 2*d* of the feed tray 2 and are, at their respective other ends, articulated to stationary pivots 7*a* and 7*b*. The upper face 2' of the feed tray 2 is, bilaterally at a downstream end 2*b* thereof, engaged by two compression springs 8*a*, 8*b* stationarily supported at their respective ends remote from the tray surface 2'.

Figure 3:
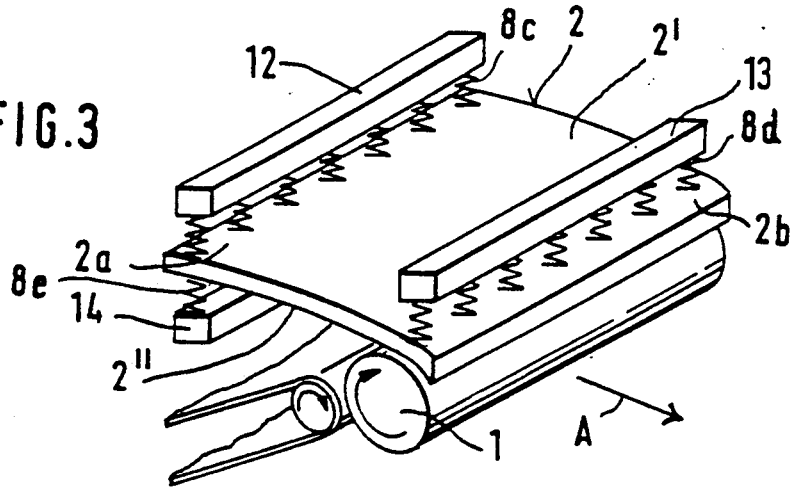

Turning to the embodiment illustrated in FIG. 3, two spring support bars 12 and 13 extend substantially along the entire width of the feed tray 2 above the respective upstream and downstream ends 2*a* and 2*b* thereof. The spring support bars 12 and 13 carry downwardly oriented series of springs 8*c* and 8*d*, respectively, for engaging the upstream and downstream ends 2*a* and 2*b* of the upper face 2' of the feed tray 2. Opposite the upstream spring support bar 12, facing the underside (working side) of the feed tray 2, a spring support bar 14 is arranged which carries a series of springs 8*e*. The spring support bars 12, 13 and 14 are stationarily supported in the machine frame; the springs 8*c* and 8*e* associated with the upstream end 2*a* of the feed tray 2 serve as a resilient holding mechanism for the feed tray 2. The spring support bars 12, 14 are in a vertical alignment with one another, that is, they are aligned as viewed along a plane that is perpendicular to the feed direction A.

Figure 4:
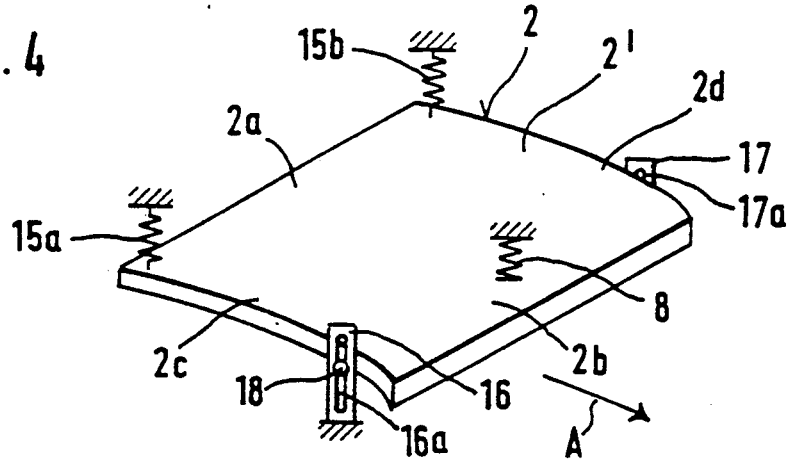

Turning to the embodiment illustrated in FIG. 4, in the upstream corner zones of the feed tray 2 tension springs 15*a* and 15*b* are provided whose other end is stationarily supported and which pull the upstream end 2*a* of the feed tray 2 upwardly. In the middle of the downstream edge zone the upper face 2' of the feed tray 2 is engaged by a compression spring 8 which has a stationarily supported other end and which urges the downstream end of the feed tray 2 downwardly. To the opposite longitudinal sides 2*c* and 2*d* of the feed tray 2, in approximate alignment with the compression spring 8, pivot pins 18 are secured (only one is visible) which are guided in vertical slots 16*a*, 17*a* of stationary guide posts 16, 17, situated at respective opposite sides 2*c* and 2*d* of the feed tray 2. This arrangement allows a vertical displacement of the feed tray 2 as well as a pivotal motion about a horizontal axis connecting the two opposite pins 18.

In the embodiment according to FIG. 5, a floatingly supported feed tray 2 is illustrated. Similarly to the FIG. 4 embodiment, linkages 11*a*, 11*b* are provided and further, similarly to FIG. 4, the upstream ends of the upper face 2' of the feed tray 2 are attached to tension springs 15*a*, 15*b*. Furthermore, a rotary bearing 19 is affixed to the upper face 2' for supporting the stub shaft 20*b* of a support bar 20 which extends parallel to the feed direction A of the fiber material. The upstream end 20*a* of the support bar 20 is attached to a transverse shaft 21 which, in turn, is rotatably supported in respective bearings 23 and 24 at both of its opposite ends. The support bar 20 is pressed downwardly by a compression spring 25 held stationarily in the machine frame. By virtue of this arrangement, the support bar 20 may swing in a vertical plane about the shaft 21 as indicated by the arrows E and F, thus providing for a radial movement of the feed tray 2 relative to the feed roll 1. The bearing 19, in turn, provides for an angular displacement of the feed tray 2 about an axis parallel to the feed direction A, as indicated by the arrows G, H. Such a motion thus provides for changes in the angular position of the feed tray 2 relative to the longitudinal axis of the feed roll 1. A stop 29 attached to the side of the feed tray at the downstream end thereof cooperates with a stationary stop 27 for preventing the feed tray 2 from contacting the feed roll 1. A similar stop arrangement 27, 29 may be provided at the other side of the feed tray 2.

The feed tray 2 according to the embodiment shown in FIG. 5 adapts itself automatically to various thicknesses of the fiber lap B in the longitudinal and transverse directions as indicated by the arrows A and K. This arrangement further ensures an at least approximately uniform pressure of the feed tray 2 on the feed roll 1 along the length and width (directions A and K) of the feed tray 2, proved that the spring 25 has a flat spring characteristic.

It is seen that in the embodiments according to FIGS. 2 to 5 the feed tray 2 is so supported that it may be displaced by forces (for example, derived from the thickness variations of the fiber lap B as it passes through the nip defined by the feed roll 1 and the tray 2) in a tilting (swinging) motion about at least two nonparallel axes, for example, a first axis which is oriented parallel to the feed direction of the fiber lap as it passes between the nip of roller 1 and tray 2 and a second axis which is oriented parallel to the rotary axis of the feed roller 1. In the embodiments shown in FIGS. 2 to 5 all such axes are substantially parallel to a plane which is defined by the rotary axis of the feed roll 1 and the feed direction of the fiber lap B. In FIG. 5 the rotary axis of the feed roller 1 is designated at 50 and the feed direction (which intersects the axis 50) at A. The plane defined by the two is designated at L.

Turning to the embodiment illustrated in FIG. 6, the feed tray 2 is suspended from a pivotal support 7 which provides for a swinging motion of the feed tray 2 about a horizontal axis extending parallel to the feed roll 1. The upper face 2' of the feed tray 2 is engaged at the upstream end 2*a* of the feed tray 2 by a tension spring 15 whose other end is attached to a stationary support 30 which, at the same time, serves as an abutment limiting the amplitude of the swinging motion of the feed tray 2 to thus prevent a contacting of the feed roll 1. The feed tray 2 of the FIG. 6 embodiment thus operates in principle as a two-arm lever wherein a pulling force is exerted at the end 2*a*, transformed into a pressing force at end 2*b* as related to the surface of the feed roll 1.

Turning now to the embodiment illustrated in FIG. 7, the feed tray 2 is operating on the principle of a one-arm lever. For this purpose, the feed tray 2 is pivotally suspended at 7 at its upstream end 2*a* and a downwardly pressing force is provided by weights 31 secured to the feed tray 2 between the pivotal suspension 7 and the downstream tray end 2*b*. Similarly to the FIG. 6 embodiment, the end 2*a* of the feed tray 2 is in an abutting relationship with a stationary stop 30 to limit the amplitude of the swinging motion of the feed tray to thus prevent its contacting the feed roll 1.

Turning now to the embodiment illustrated in FIG. 8, above the nip defined between the feed roll 1 and the opening roll 3 a shaped transverse bar 36 is provided which has a wall 36*a* supporting a transverse rubber hose 34. Such pressure may be maintained by means of an external pressure vessel 40 connected to the hose 34 by a conduit 41. The feed roll 1 has a clothing 1*b* which cooperates with a feed tray constituted by a comb-like member 37 illustrated in more detail in FIG. 10. The rubber hose 34 which is situated between the comb 37 and the bar 36 has an inner space 34*b* in which a pressure of, for example, 10 arm prevails. The rubber hose 34 is, with its outer face 34*a*, partially in contact with the wall 36*a* of the bar 36 and also engages the comb 37. The comb 37 has a wide base 37' from which extend unilaterally open, narrow comb tines 37*a*. The comb construction allows a localized bulging of the feed tray structure; the extent of such bulging is in proportion to the length of the tines. Furthermore, the tines 37*a* have a tine width b and, by virtue of the clearance a between tines, they may move in the transverse direction, that is, in the plane of the comb 37. The comb 37 may be an elastic material such as a ZX 100 plastic.

Turning now to the embodiment illustrated in FIG. 9, the construction is similar to that shown in FIG. 8 except that the force-exerting element is a solid rubber bar 35 made of soft rubber. The comb base 37' is clamped into a holding element 38. On the working face of the comb 37, oriented towards the fibers, a support element 39 is provided to prevent the tines 37*a* from contacting the feed roll 1. The fiber material presses the tines 37*a* at least partially against the rubber elastic element 34 (FIG. 8) or 35 (FIG. 9) which deforms in response to such pressure.

The invention encompasses a solution wherein the feed roll of the feeding device is supported such that it is displaceable towards and away from the feed tray and there is provided a force-exerting element which urges the feed roll towards the feed tray.

It will be understood that the above description of the present invention is susceptible to various modifications, changes and adaptations, and the same are intended to be comprehended within the meaning and range of equivalents of the appended claims.

What is claimed is:

1. A feeding device for advancing a fiber lap to a fiber processing machine, comprising:

(a) a feed roll;

(b) means for rotating said feed roll about a rotary axis thereof;

(c) a feed tray cooperating with said feed roll and defining a nip therewith for advancing the fiber lap in a feed direction by a clamping effect exerted to the fiber lap in said nip by said feed roll and said feed tray; said feed tray having a working face oriented towards said feed roll and an outer face being opposite said working face; said feed tray further having a first end adjacent said feed roll and a second end remote from said feed roll;

(d) support means for supporting said feed tray for tilting movements about at least two non-parallel axes towards and away from said feed roll; and (e) a force-exerting means connected to said feed tray for urging said working face of said feed tray towards said feed roll.

2. A feeding device as defined in claim 1, wherein said force-exerting means comprises a spring.

3. A feeding device as defined in claim 1, wherein a distance between said working face of said feed tray and said feed roll decreases in said feed direction.

4. A feeding device as defined in claim 3, wherein said distance is the smallest in a clamping plane of said nip.

5. A feeding device as defined in claim 1, wherein said support means comprises a pivotal support to provide for a pivotal motion of said feed tray.

6. A feeding device as defined in claim 1, wherein said force-exerting means comprises springs attached to said feed tray at said first end thereof.

7. A feeding device as defined in claim 1, wherein said feed roll is oriented horizontally and the rotary axis thereof is perpendicular to said feed direction and further wherein said support means comprises means for supporting said feed tray for a pivotal motion about a horizontal axis.

8. A feeding device as defined in claim 1, wherein said support means comprises means for supporting said feed tray for a pivotal motion about an axis substantially parallel to said feed direction.

9. A feeding device as defined in claim 1, wherein said support means comprises a bar extending parallel to said feed direction and a stationarily held pivot attached to a first end of said bar to provide for a pivotal motion of said bar about an axis oriented parallel to said rotary axis of said feed roll; said bar having a second end carrying said means for supporting said feed tray for a pivotal motion about an axis extending substantially parallel to said feed direction.

10. A feeding device as defined in claim 1, wherein said support means comprises means for supporting said feed tray to provide displacements thereof in said feed direction and in a direction parallel to said feed roll.

11. A feeding device as defined in claim 10, wherein said support means comprises fixedly held spring support bars extending parallel to said feed roll at opposite faces of said feed tray at said second end thereof; each spring support bar carrying a series of springs engaging opposite faces of said feed tray; said spring support bars being substantially in alignment with one another as viewed in a plane oriented perpendicularly to said feed direction.

12. A feeding device as defined in claim 1, further comprising guide posts stationarily supported on either side of said feed tray, a guide slot provided in each said guide post and guide pins affixed to said feed tray and engaging into a respective said guide slot, whereby said feed tray is guided towards and away from said feed roll.

13. A feeding device as defined in claim 1, wherein said feed tray is a single-piece member in a direction parallel to said rotary axis of said feed roll.

14. A feeding device as defined in claim 1, wherein further comprising an opening roll immediately following the feed roll in a direction downstream of said feed roll relative to said feed direction for directly receiving fiber material advanced by said feed roll in cooperation with said feed tray; said feed roll and said opening roll having opposite directions of rotation.

15. A feeding device as defined in claim 14, wherein said opening roll is a pinned roll.

16. A feeding device as defined in claim 1, wherein said feed roll is horizontally oriented and said feed tray is situated above said feed roll.

17. A feeding device as defined in claim 1, wherein said support means and force-exerting means comprise linkages each having one end articulated to said feed tray at said second end of said feed tray and each having an opposite end articulated to a stationary component; and a compression spring supported by a stationary component and engaging said outer face of said feed tray at said first end thereof.

18. A feeding device as defined in claim 1, wherein said non-parallel axes extend parallel to a plane defined by said feed direction and said rotary axis of said feed roll.

19. A feeding device as defined in claim 11, further comprising an additional spring support bar carrying a series of compression springs engaging said outer face of said feed tray in a zone of said first end.

20. An apparatus for cleaning and opening fiber tufts, comprising an opening device including an opening roll and a feeding device for advancing a fiber lap to said opening roll; said feeding device including (a) a feed roll;

(b) means for rotating said feed roll about a rotary axis thereof;

(c) a feed tray cooperating with said feed roll and defining a nip therewith for advancing the fiber lap in a feed direction by a clamping effect exerted to the fiber lap in said nip by said feed roll and said feed tray; said feed tray having a working face oriented towards said feed roll and an outer face being opposite said working face; said feed tray further having a first end adjacent said feed roll and a second end remote from said feed roll;

(d) support means for supporting said feed tray for tilting movements about at least two non-parallel axes towards and away from said feed roll; and (e) a force-exerting means connected to said feed tray for urging said working face of said feed tray towards said feed roll.

21. A feeding device as defined in claim 1, further comprising abutment means for limiting displacements of said feed tray for preventing said feed tray from contacting said feed roll.

* * * * *